United States Patent [19]

Wake

[11] 4,398,404

[45] Aug. 16, 1983

[54] KEY DISENGAGEMENT PREVENTIVE DEVICE FOR MAGNETIC TUMBLER CYLINDER LOCKS

[75] Inventor: Kiyoyasu Wake, Yokohama, Japan

[73] Assignee: Miwa Rokku Kogyo Kabushiki Kaisha, Japan

[21] Appl. No.: 218,515

[22] Filed: Dec. 22, 1980

[30] Foreign Application Priority Data

Mar. 10, 1980 [JP] Japan ..... 55/29135

[51] Int. Cl.[3] ..... E05B 27/06; E05B 47/00

[52] U.S. Cl. ..... 70/276; 70/358; 70/364 A

[58] Field of Search ..... 70/276, 358, 364 A, 70/364 R

[56] References Cited

U.S. PATENT DOCUMENTS

| | | | |
|---|---|---|---|
| 2,121,301 | 6/1938 | Ractliffe | 70/276 |
| 3,393,541 | 7/1968 | Wake | 70/276 |
| 3,512,382 | 5/1970 | Check | 70/358 |

*Primary Examiner*—Robert L. Wolfe

*Attorney, Agent, or Firm*—David L. Garrison

[57] ABSTRACT

The present invention relates to a magnetic tumbler cylinder lock mechanism having enhanced safety because of a key disengagement preventive device that prevents the key from disengagement from the key hole when the lock mechanism is in the fully locked or fully unlocked position.

5 Claims, 9 Drawing Figures

KEY DISENGAGEMENT PREVENTIVE DEVICE FOR MAGNETIC TUMBLER CYLINDER LOCKS

BACKGROUND OF THE INVENTION

In conventional magnetic tumbler cylinders, the magnetic key used to operate the lock is not formed with notches such as a pin cylinder, and therefore, the key can be inserted and disengaged from the key hole very smoothly at any angular location. As a result the key may be disengaged during rotation of the cylinder resulting in a possible incomplete operation. Particularly when the key is disengaged from a position other than the normal position during the locking operation, the tumbler is not fully engaged within the tumbler groove so the cylinder remains free to rotate and thus the lock mechanism may be unlocked by means of any key or other tool without need for the correct key. In order to prevent the disadvantages noted above, there is proposed a method (Japanese Design Registration No. 378,792 and Japanese Utility Model Publication No. 25,586/71) in which recess portions are provided in the key and inner cylinder, and ball or pin is placed in which engagement with said recess portions or a method in which a convex portion is provided in a part of a key and said convex portion engages a part of an inner cylinder so as to avoid insertion and removal of a key from key hole at a position other than the normal position. However, in case of these methods, since the ball or pin and the convex portion of the key are interengaged the function of preventing removal of the key fails if the precision thereof is poor or if use thereof is made for a long period of time even though the precision is good with the result that a wear occurs, and as a consequence, phenomenon of removal of a key from key hole at an undesirable position occurs, thus suffering from occurrence of such a trouble as noted above.

In order to eliminate those disadvantages noted above with respect to prior arts, the present invention provides an arrangement wherein a plurality of disengagement preventive pins are provided within a conventional magnetic tumbler cylinder, said pins each being divided into an upper pin segment and a lower pin segment and a correct key therefore is provided with a plurality of the corresponding key magnets and recesses in engagement with the lower pin segment so that when a correct key is inserted into a key hole, the magnetic tumbler and a border surface between the upper pin segment and the lower pin segment are respectively aligned with a shear line permitting rotation of the cylinder.

The advantages of the present invention may be summarized as follows:

(1) Since the disengagement preventive pins provided are plural in number instead of a single as in prior arts, the normal position at which a correct key is disengaged is far more accurate as compared to prior arts. In addition, even after use for many years, the precision can be maintained sufficiently.

(2) The ancillary effect of the present invention is that in a state where a key is pulled out of the cylinder, that is, in a locked state, the upper pin segment 6 interrupts the shear line, and therefore, even if an attempt is made to forcibly rotate the inner cylinder 2 falsely by means of a screw driver or the like, a plurality of upper pin segments 6 bear a part in restricting such forcible rotation, thereby greatly increasing the resistance to forcible rotation thereof as compared to the conventional cylinder merely comprising a magnetic tumbler.

(3) Further, in an attempt of so-called picking, in the case of the conventional magnetic tumbler cylinder, arrangement of magnetic poles can read externally by some means resulting in a possible reproduction of a key. However, the present invention provides a further ancillary effect that the magnetic tumbler may be moved in a manner as described and at the same time, a border surface between the lower pin segment 5 and the upper pin segment 6 of a plurality of disengagement preventive pins has to be aligned one by one with the shear line. False unlocking (picking) in which the complicated operations for the individual alignment of both groups of magnetic tumblers and group of disengagement preventive pins within a narrow limited space which is a key hole are simultaneously executed is extremely difficult, and thus the safety of the lock device increased greatly as compared to the conventional magnetic tumbler cylinder.

SUMMARY OF THE INVENTION

The magnetic tumbler cylinder of the present invention provides a key disengagement preventive device wherein key disengagement preventive pins each comprising an upper pin segment and a lower pin segment are mounted in a plurality of pin holes reaching a key hole through an inner cylinder and an outer cylinder. The device is constructed and arranged so that when a key is inserted into the key hole, a plurality of recesses in the key come into engagement with of said lower pin segments and a border surface between the upper pin segment and the lower pin segment is aligned with a shear line. According to the above composition, the present invention makes the key disengagement from the key hole impossible, except when the key is in the normal position wherein the lower pin segments meet with the upper pin segments. Therefore, the key disengagement preventive device of the present invention has an advantage that the normal position at which a correct key is disengaged is more accurate as compared to the conventional magnetic tumbler cylinder, and to be able to hold the key disengagement preventive device of the present invention function for a long time, becuase the key disengagement preventive consists of the plurality of recesses of the key and key disengagement preventive pins extend in axial direction of the cylinder and the key.

BRIEF DESCRIPTION OF THE DRAWINGS

FIG. 8(*b*) is a cross sectional view of a key used in the third embodiment;

FIG. 9(*b*) is a top view of a key used in the fourth embodiment.

DESCRIPTION OF THE PREFERRED EMBODIMENTS

Figure 1:
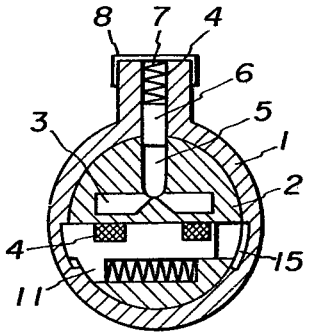
FIG. 1 is a cross sectional view of a cylinder in accordance with the present invention.
Figure 2:
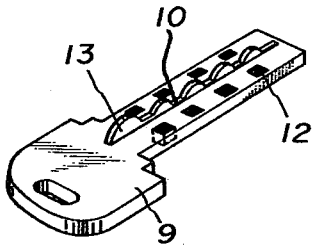
FIG. 2 is a perspective view of a key in accordance with the present invention.

The present invention will be described by way of embodiments thereof described in the drawings. In the present invention, as shown in FIG. 1, disengagement preventive upper pin segment 6 and lower pin segment 5 are incorporated into a well known magnetic tumbler cylinder (for example, Japanese Patent Laid-Open No. 127,092/1978). The cylinder of the present invention comprises an inner cylinder 2 and an outer cylinder 1 similar to a conventional cylinder. On the other hand, a correct key 9, as shown in FIG. 2, has a key magnet 12 for a magnetic tumbler embedded therein and a spine 13 extended therefrom to form a recess 10 which engages the lower pin segment 5. There is provided a pin hole 4, which extends from the outer cylinder 1 of the cylinder through the inner cylinder 2 and reaching the key hole 3, to receive therein the lower pin segment 5, the upper pin segment 6 and a spring 7 which are sealed by a cover 8. These pin holes are provided in a key inserting direction. The lower pin segment 5 and upper pin segment 6 are of various lengths, and the length of each pin segment 5 is determined so that when the correct key 9 is inserted into the key hole, the recess 10 in the correct key 9 engages and positions the lower pin segment 5 so that a border surface formed beyween the lower pin segment 5 and the upper pin segment 6 is aligned with a shear line. (FIG. 3)

Figure 4:
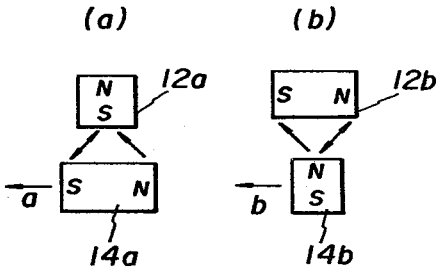
FIG. 4 is a view of assistance in explaining the arrangement of magnetic poles.

The magnetic tumbler portion of the cylinder in the present embodiment has its construction similar to that of Japanese Patent Laid-Open No. 127,092/1978 filed by the present applicant. That is, as shown in FIG. 4(*a*), S-pole of a key magnet 12*a* and S-pole of a tumbler magnet 14*a* repel each other whereas S-pole of the key magnet 12*a* and N-pole of the tumbler magnet 14*a* attract each other so that the tumbler magnet 14*a* is moved in a direction of arrow a. Also, as shown in FIG. 4( *b*), S-pole of a key magnet 12*b* and N-pole of a tumbler magnet 14*b* attract each other whereas N-pole of the key magnet 12*b* and N-pole of the tumbler magnet 14*b* repel each other so that the tumbler magnet 14*b* is moved in a direction of arrow b. By arrangement of the N-pole and S-pole as described above, a magnetic force between the tumbler magnets 14*a*, 14*b* and the key magnets 12*a*, 12*b* remains substantially constant irrespective of relative distance, and the operational force of the magnetic tumblers 14*a*, 14*b* increases in comparison to conventioned one and so it is possible to set a relatively strong tumbler spring for a magnetic tumbler cylinder.

Next, the operation of the cylinder according to the present invention will be described.

Figure 3:
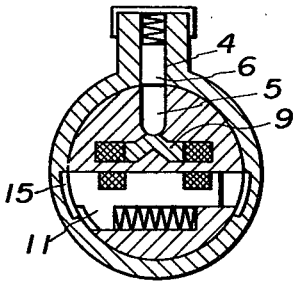
FIG. 3 is a cross sectional view showing a state in which a correct key is inserted into the cylinder of FIG. 1.
Figure 5:
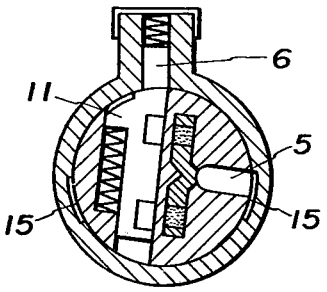
FIG. 5 is a cross sectional view showing a state where the FIG. 3 cylinder is rotated.
Figure 6:
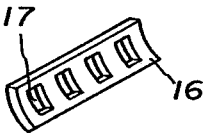
FIG. 6 is a perspective view of a spacer.

When the correct key 9 is inserted into the key hole 3, the lower pin segment 5 engages the recess 10 of the spine 13 of the key 9, and is moved to the position shown in FIG. 3, whereby the border surface between the lower pin segment 5 and the upper pin segment 6 is aligned with a shear line. In addition, the key magnet 12 embedded in the key 9 and the tumbler magnet 14 of the magnetic tumbler 11 interact so that the magnetic tumbler 11 is withdrawn into the inner cylinder so that its outer surface is aligned with the shear line. In this manner, the lower pin segment 5, the upper pin segment 6, and the magnetic tumbler 11 are aligned with the shear line as shown in FIG. 3, and in this state, the cylinder becomes rotatable to effect locking and unlocking. Incidentally, a spacer 16 as shown in FIG. 6, is disposed within a magnet tumbler groove 15, to prevent the lower pin segment 5 from being fallen into the tumbler groove 15 for the magnetic tumbler 11 disposed in an inner surface of the outer cylinder resulting from rotation of the inner cylinder 2 as shown in FIG. 5. This spacer is designed so that it is received into the tumbler groove 15 formed in a dovetail shape and only a portion thereof plunged into the magnetic tumbler 11 is formed with a window-shaped hole 17, said window-shaped hole 17 and said pin hole 4 being displaced in an axial direction of the cylinder. That is, the position at which the magnetic tumbler 11 and the lower pin segment 5 are present in the inner cylinder 2 is axially displaced. However if the width of the window-shaped hole 17 is made smaller than the diameter of the pin segment, the position need not be displaced.

When the correct key 9 is pulled out of the key hole 3 after the locking or unlocking operation has been completed, the correct key 9 cannot be pulled out at a position other than the normal position, i.e. the position at which the lower pin segment 5 coincides with the upper pin segment 6, even if an attempt is made to pull out the correct key because the lower pin segment 5 is prevented from movement radially by its engagement upon the inner surface of the outer cylinder 1. In this case, since a plurality of disengagement preventive pins are provided in the normal position for removal of key 9, a more accurate angular positioning of the inner cylinder 2 is required as compared to prior art devices which have only one such position. In addition, even after use for many years, higher precision can be maintained sufficiently as compared to prior art devices which have only one such position.

Figure 7:
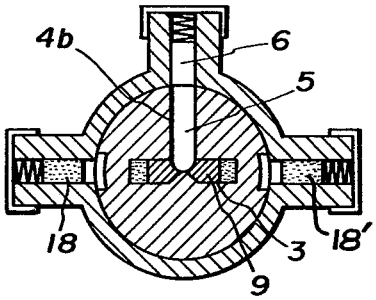
FIG. 7 is a cross sectional view showing a second embodiment of the present invention.
Figure 8:
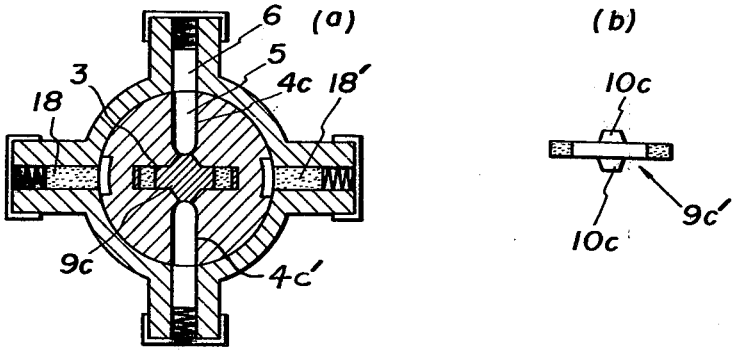
FIG. 8(*a*) is a cross sectional view showing a third embodiment of the present invention.
Figure 9:
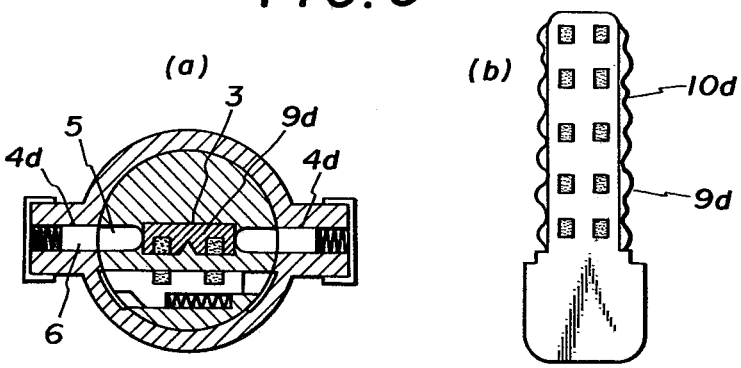
FIG. 9(*a*) is a cross sectional view showing a fourth embodiment of the present invention.

FIGS. 7 to 9 show other embodiments of the present invention. In the two embodiments shown respectively in FIGS. 7 and 8 the magnetic tumblers 18 and 18' are positioned on a transverse axis extending in a direction perpendicular to the axis of key hole 3 into which a correct key 9*b* and 9*c* are shown inserted. In these embodiments the present invention has been applied to a conventional magnetic tumbler cylinder of different type, and this has no particular difference in operation from the first-mentioned embodiment and thus a description therefore is not further made. In FIG. 7, the pin hole 4*b* is provided only at one side of the key hole 3. In the construction shown in FIG. 8, the disengagement preventive pin holes 4*c* and 4*c'* are provided so that they reach the key hole 3 from upper and lower portions as shown. In this case, a correct key 9*c* has spines 10*c* and 10*c'* provided on both faces thereof as shown in FIG. 8(*b*). In the construction shown in FIG. 9, pin holes 4*d* of the disengagement preventive pins are provided on an axis extended lengthwise in the sectional shape of cross-section of the key hole 3, and the operation thereof has no difference from that of the first embodiment and thus a description thereof is not further made. In this case, a correct key 9*d* has recesses 10*d* in both sides thereof. [FIG. 9(*b*)].

While my invention has been described above by reference to certain specific embodiments, it is to be understood that the various embodiments shown are given by example only and not in a limiting sense.

I claim:

1. A magnetic tumbler lock mechanism having an outer cylinder and an inner cylinder rotatably about an axis of rotation said mechanism comprising:

a key receiving recess, rectangular in cross section formed in said inner cylinder and adapted to receive a flat key having key magnets therein and a spline means projecting from one flat surface thereof for keying engagement with axially moveable pin means;

a tumbler groove positioned non-axially in said outer cylinder to receive a tumbler magnet movable into locking engagement with said groove;

a non-axially positioned tumbler magnet means mounted in said inner cylinder and adapted to move parallel to and across the face of said key from a first locked position to a second disengaged position upon insertion of said key into said key receiving recess;

a key disengagement preventive device comprising an upper pin segment and a lower pin segment mounted in a pin hole extending through said inner cylinder and said outer cylinder; and, spacer means positioned within said tumbler groove preventing travel of said lower pin segment into said tumbler groove;

whereby engagement of said key into a key hole moves said upper and lower pin segments outwardly so that a border surface between the upper pin segment and the lower pin segment is aligned with a shear line permitting relative rotation of said inner cylinder with respect to said outer cylinder and preventing removal of said key except upon re-alignment of said pin segments.

2. The magnetic tumbler cylinder according to claim 1, wherein a plurality of key disengagement preventive pins are provided, segments thereof having differing lengths.

3. The magnetic tumbler cylinder according to claim 1, wherein said pin segments are urged inwardly of said cylinder by spring means.

4. The magnetic tumbler cylinder according to claim 1, wherein a pin hole is provided which reaches a central portion on one side of the key hole.

5. The magnetic tumbler cylinder according to claim 1 or 2, wherein pin holes are provided on an axis extended lengthwise in the shape of cross-section of the key hole.

* * * * *